US007340795B2

(12) United States Patent
Kaleta

(10) Patent No.: US 7,340,795 B2
(45) **Date of Patent: *Mar. 11, 2008**

(54) FLOOR SWEEPER

(76) Inventor: Bryan Kaleta, 1037 Hinswood Dr., Darien, IL (US) 60561

( * ) Notice: Subject to any disclaimer, the term of this patent is extended or adjusted under 35 U.S.C. 154(b) by 370 days.

This patent is subject to a terminal disclaimer.

(21) Appl. No.: 11/174,159

(22) Filed: Jul. 1, 2005

(65) Prior Publication Data

US 2005/0268410 A1 Dec. 8, 2005

Related U.S. Application Data

(63) Continuation-in-part of application No. 10/861,705, filed on Jun. 3, 2004, now Pat. No. 7,152,267.

(51) Int. Cl.
*A47L 11/24* (2006.01)

(52) U.S. Cl. ..... 15/42; 15/41.1; 15/52.1

(58) Field of Classification Search ..... 15/41.1, 15/42, 52.1

See application file for complete search history.

(56) References Cited

U.S. PATENT DOCUMENTS

| | | | | |
|---|---|---|---|---|
| 2,536,902 | A * | 1/1951 | Beckett | 15/345 |
| 3,740,783 | A * | 6/1973 | Kopecky | 15/3 |
| 4,426,751 | A * | 1/1984 | Nordeen | 15/384 |
| 5,289,605 | A * | 3/1994 | Armbruster | 15/97.1 |
| 6,185,776 | B1 * | 2/2001 | Windmeisser | 15/49.1 |
| 6,442,792 | B1 * | 9/2002 | Sudou et al. | 15/339 |
| 2004/0237228 | A1 * | 12/2004 | King et al. | 15/50.1 |

FOREIGN PATENT DOCUMENTS

| | | |
|---|---|---|
| JP | 3-244429 | * 10/1991 |
| JP | 2001-212053 | * 8/2001 |

* cited by examiner

*Primary Examiner*—Mark Spisich
(74) *Attorney, Agent, or Firm*—Knechtel, Demeur & Samlan

(57) ABSTRACT

A floor sweeper head is mounted to an elongated handle by a universal pivot or universal joint which allows the floor sweeper head to easily pivot about the handle in any direction to pick up debris under over hanging cabinets or under furniture. The floor sweeper has sweeping brushes mounted around all sides of the sweeper head to provide sweeping action in any direction. All of the brushes are powered by a small electric motor. There is a battery mounted on the elongated handle and electrical connections are provided through the elongated handle and through the universal pivot to the electric motor so that power is provided to the brushes regardless of the orientation of the elongated handle.

12 Claims, 6 Drawing Sheets

FLOOR SWEEPER

CROSS-REFERENCE TO RELATED APPLICATIONS

This application is a continuation in part application based on and claims priority of patent application Ser. No. 10/861,705 filed Jun. 3, 2004 now U.S. Pat. No. 7,152,267.

BACKGROUND AND SUMMARY OF THE INVENTION

This invention relates to handheld floor sweepers and more particularly to a hand held floor sweeper having a plurality of sweeping brushes powered by an electric motor. The floor sweeper has an elongated handle that has a battery pack to supply power to the electric motor. This invention is directed to the wiring means to provide the power from the battery pack to the electric motor.

Handheld sweepers have been used in the past to pick up dust and small items from hard surfaces, such as wood or tile floors, and carpets having varying piles of various heights. One type of handheld floor sweeper that has been used extensively in the past is a manually pushed floor sweeper that is not powered by a motor. The handheld sweeper has brushes mounted on a shaft located in the sweeper head that contact the surface to be cleaned. The brushes rotate as the sweeper is pushed and pulled across the floor surface. The brushes rotate and the bristles sweep the loose material up into a dust canister or similar dust-receiving portion in the sweeper head. A problem with this type of floor sweeper is that it only picks up material in the forward or rearward direction as the user pushes or pulls the sweeper across the floor as the sweeper is designed for movement in just the forward or reward directions. The sweeper head does not rotate about its handle for movement in the left or right directions, nor does it easily change directions for cleaning under low overhanging objects such as under cabinets or furniture.

The invention disclosed herein is a new type of floor sweeper, which is extremely light and has a very low profile sweeper head. The floor sweeper head is mounted to an elongated handle by means of a universal pivot or universal joint. This allows the floor sweeper head to easily pivot about the handle in any direction for easily picking up loose materials under over hanging cabinets or under furniture. There is an electric motor mounted in the sweeper head that drives the brushes mounted around all four sides of the sweeper head. There is a rechargeable battery pack mounted on the elongated handle to provide power to the electric motor. Through unique wiring channels, power is provided to the motor from the battery pack through the elongated handle and the universal pivot or universal joint. The brushes provide cleaning action in any direction, not just in the forward or reverse direction. The motor drives the brushes to direct the dust or loose material into the dust-receiving canister in the sweeper head. Furthermore there are brushes extending out from the sides of the sweeper head that reach into corners to sweep debris into the main brushes. All of the brushes are powered by a small electric motor.

OBJECTS OF THE INVENTION

It is an object of the invention to provide a handheld sweeper that has sweeper brushes in the sweeper head to clean a surface regardless of which direction the sweeper is moved. It is a related object to provide a handheld sweeper that has a battery pack mounted on the elongated handle to provide power to an electric motor in the sweeper head to rotate the sweeper brushes.

It is another object to provide a handheld sweeper that has an elongated handle connected to the sweeper head by means of a universal pivot or universal joint. Related thereto is the object of providing electric power from the battery pack to the electric motor through the elongated handle and universal pivot without interfering with the pivotal movement of the handle with respect to the sweeper head.

DETAILED DESCRIPTION OF THE PREFERRED EMBODIMENT

Figure 1:
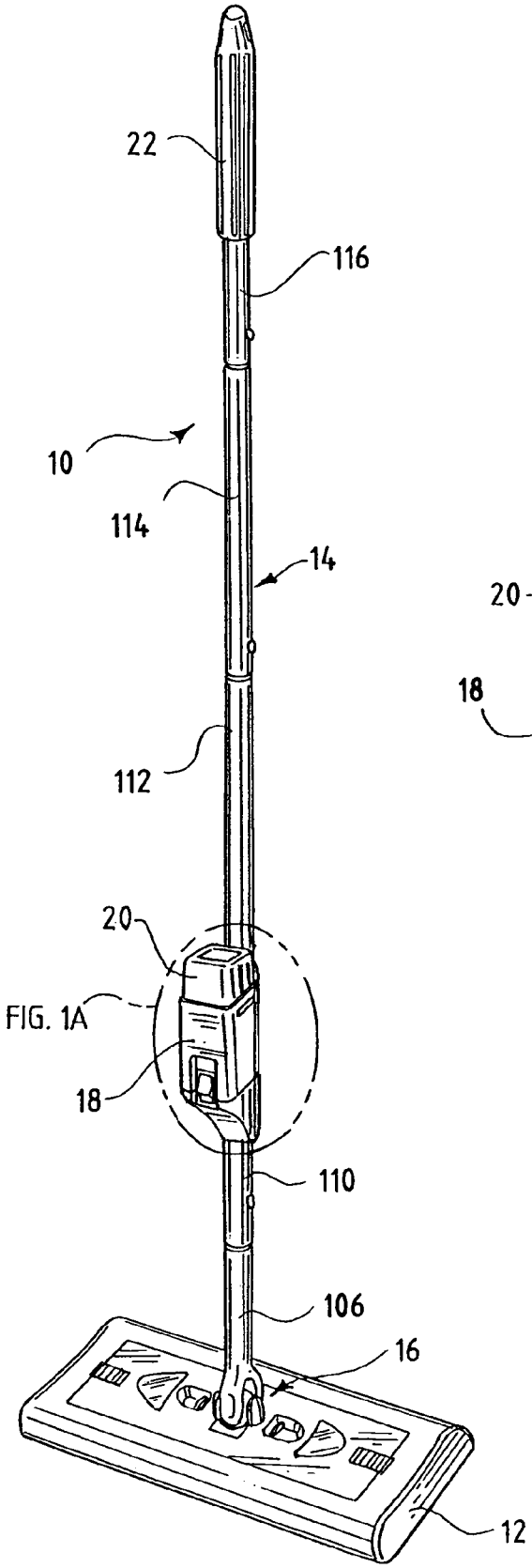
FIG. 1 is a perspective view of the handheld sweeper.
Figure 1A:
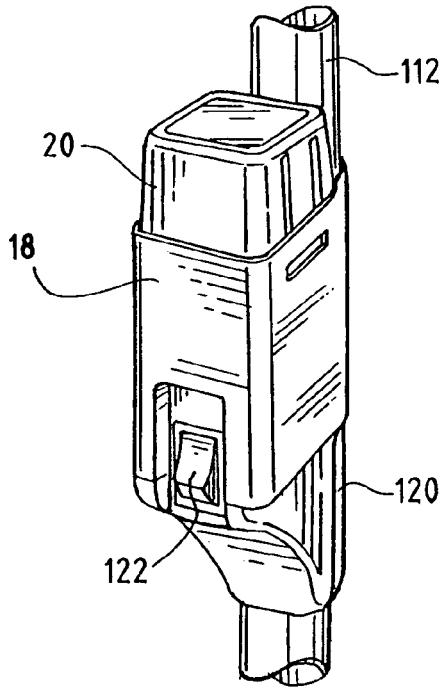
FIG. 1A is an enlarged perspective view of the battery pack shown in the encircled portion on FIG. 1.

Turning first to FIG. 1 a sweeper 10 of the present invention is disclosed. There is a sweeper head 12 connected to an elongated handle 14 by means of a universal pivot 16. Mounted on the elongated handle 14 is a battery box 18 that contains a rechargeable battery 20. At a top end of the elongated handle 14 is a grasping portion 22 which the user holds to push, pull or otherwise move the sweeper 10.

Figure 2:
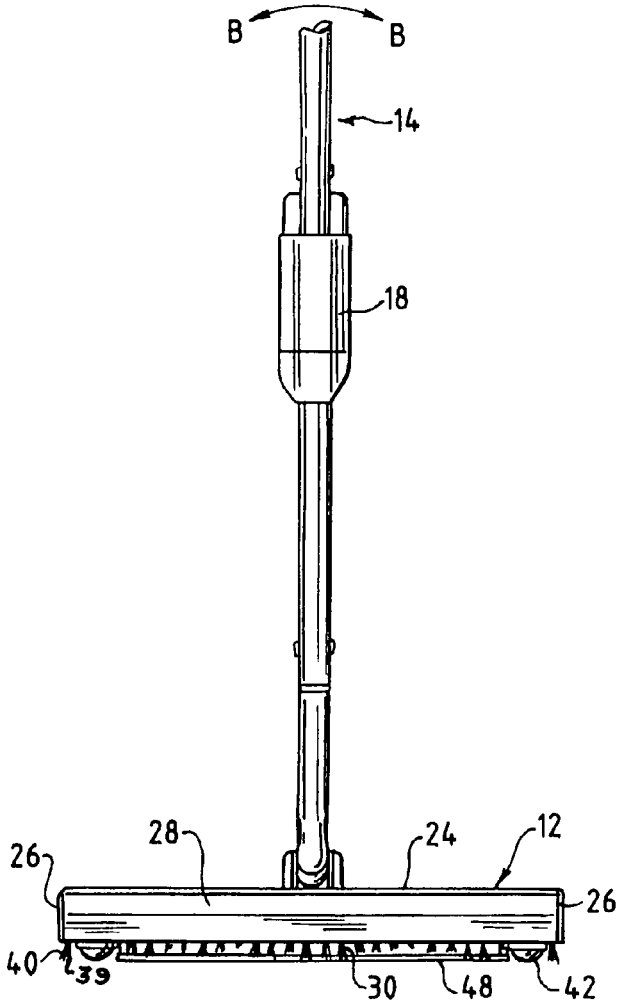
FIG. 2 is a front elevation view with portions removed of the hand sweeper.
Figure 3:
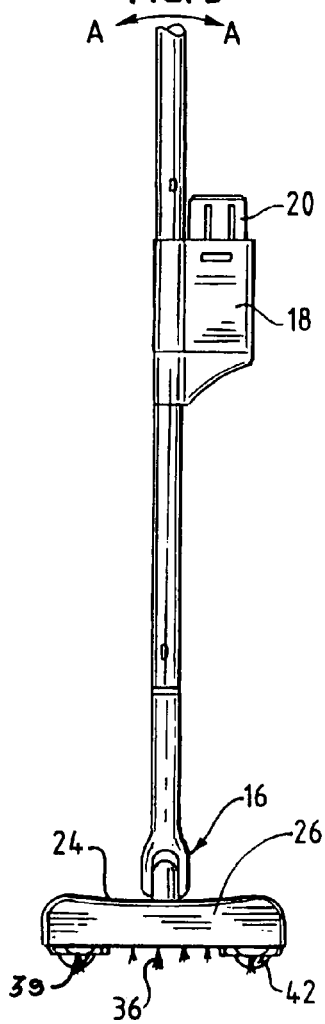
FIG. 3 is a left side view of the sweeper with portions removed.

FIGS. 2 and 3 illustrate the outer design of the sweeper head 12. The sweeper head 12 has a housing comprised of a rectangular top 24, short sides 26 and long sides 28. The universal pivot 16 is attached to the top 24.

Figure 4:
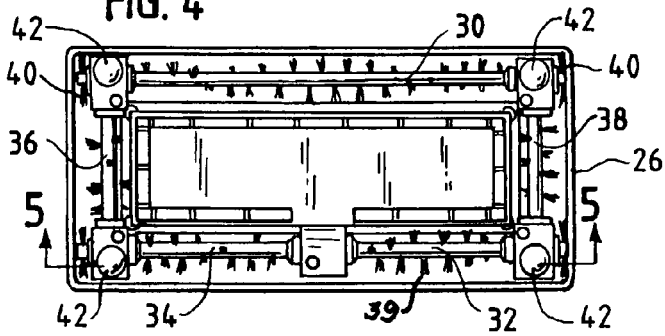
FIG. 4 is a bottom view of the sweeper.

FIG. 4 illustrates the underside of the sweeper head 12. Mounted along one of the long sides 28 at the front of the sweeper head 12 is a long brush 30. Mounted along the other long side 28 at the rear of the sweeper head 12, are a pair of rear brushes 32, 34. Along one of the short sides 26 is a first side brush 36 and along the opposite short side is a second side brush 38. Mounted to or integrally formed in the brushes 30, 32, 34, 36 and 38 are radially extending bristles 39 that are designed to contact the surface to be cleaned and sweep the debris up from the surface.

Corner brushes 40 are mounted with the plane of the bristles substantially parallel to the sides 26 at each of the four corners. However, the bristles of the corner brushes 40 are spread out in the plane parallel to the short side 26 so that the bristles actually extend out beyond the short sides 26. This enables the bristles of the corner brushes 40 to contact and clean a corner formed between the floor and a wall or other upstanding surface. If the bristles do not extend at least under the short sides 26, the short sides 26 contact the wall or other upstanding surface and will not allow the corners to be swept. All of the brushes are mounted on shafts so that the brushes can freely rotate.

The sweeper head 12 slides on high gloss, high polished plastic slides or glides 42 as seen in FIGS. 2-4. These are positioned in each of the four corners of the sweeper head 12 and allow the sweeper head 12 to easily glide over both a hard surface and carpet. Rollers may replace these glides. Furthermore the sweeper head can be easily moved in any direction along the surface to be cleaned, and the arrangement of the rollers along the front, rear and sides result in the sweeping of debris from the surface regardless of the direction of movement.

Figure 6:
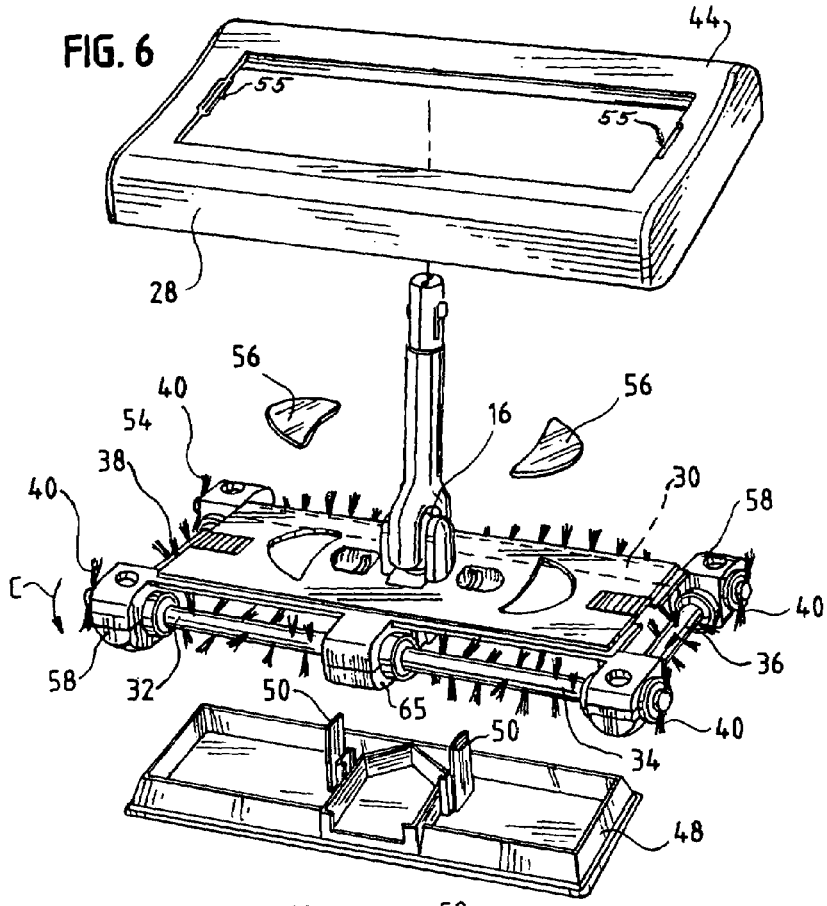
FIG. 6 is a partially exploded view of the sweeper head.
Figure 7:
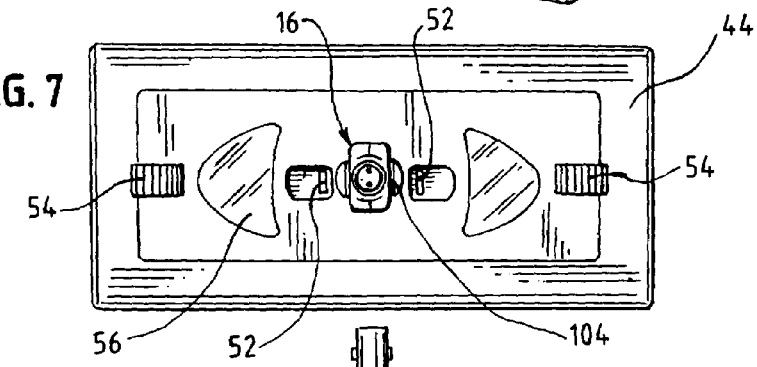
FIG. 7 is a top view of the sweeper head.
Figure 8:
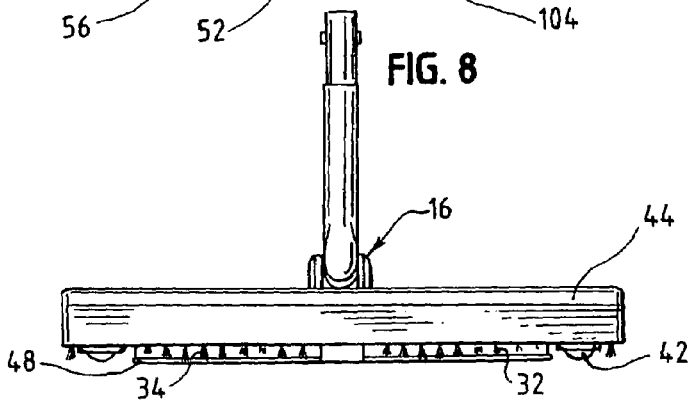
FIG. 8 is a rear view of the sweeper head with the elongated handle removed.

The sweeper head 12 has a top casing 44 as seen in FIG. 6. The brushes are mounted on a chassis 46. The universal pivot 16 is also mounted to the chassis 46. A dust receiving tray 48 is positioned below the chassis 46. Locating and locking tabs 50 extend upwardly from the dust receiving tray 48. These tabs 50 extend through receiving slots 52 in the chassis 46. The slots 52 have locking means to engage and lock the tabs 50 within the slots 52. Sliding tabs 54 on the chassis 46 can slide outward to engage indentations 55 in the top casing 44. In this manner the chassis 46 is placed in locking engagement with the top casing 44. When the dust receiving tray 48 is full and is to be emptied, the tabs 50 are pushed to one side which unlocks them for the slots 52 and the dust receiving tray 48 is released for emptying. Two plastic windows 56 mounted in the top of the chassis 46 allow the user to observe the inside of the dust receiving tray 48 so that it can be emptied when it is full of debris. FIG. 7 illustrates the dust receiving tray 48 and chassis 46 attached to the casing 44.

Figure 9:
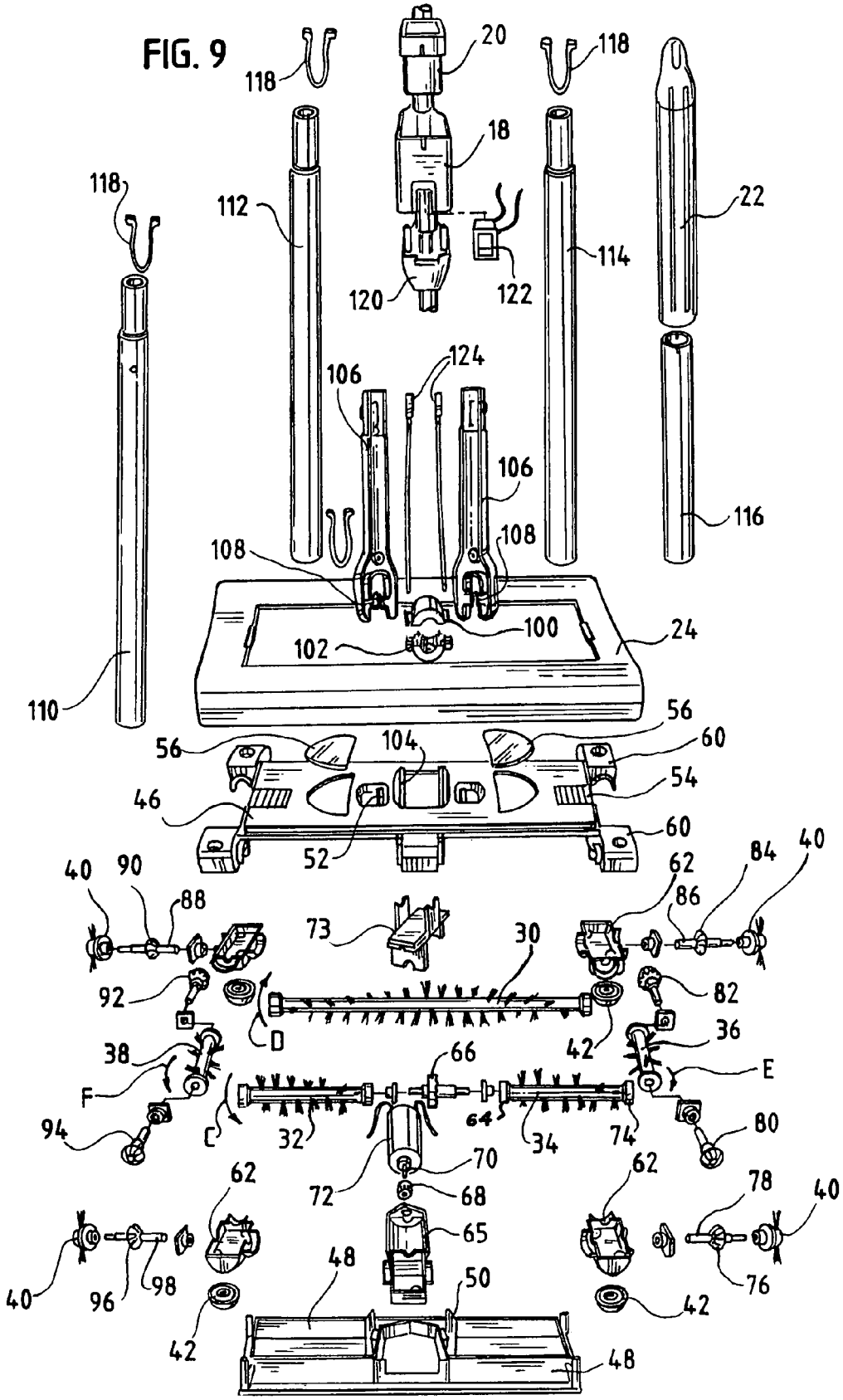
FIG. 9 is a fully exploded view of the sweeper head.

As seen in FIGS. 6 and 9, each of the brushes 30, 32, 34, 36 and 38 is mounted on shafts for rotation. The ends of the brushes are mounted in gear housings 58 comprised of a top housing 60 and a bottom housing 62. The shafts 34, 36, 30, 38 and 32 are mechanically interconnected as described herein. One end 64 of shaft 34 is mounted in a motor housing 65. Gear 66 is mounted on the one end 64 of shaft 34 and is driven by pinion 68 which, in turn, is mounted on drive shaft 70 of a motor 72. The motor 72 is mounted in motor housing 65 and supported by a motor bracket 73. Other end 74 of shaft 34 is mounted in the gear housing 58. Bevel gear 76, mounted on shaft 78, is mounted to other end 74 of shaft 34 within the gear housing 58. Shaft 78 extends out from the gear housing 58 and has a corner brush 40 mounted at its end opposite the other end 74. A complementary bevel gear 80 is mounted on the shaft of first side brush 36, which is an adjacent 90-degree shaft. Similarly bevel gear 82 is mounted at the other end of the shaft. Complementary bevel gear 84, which is mounted on shaft 86, engages bevel gear 82. These gears are located in a second gear housing 58. Shaft 86 is connected to one end of long brush 30. In a similar arrangement the other end of long brush 30 has shaft 88 connected to it with bevel gear 90 mounted on it. Complementary bevel gear 92 engages bevel gear 90. These gears are located in a third gear housing. Gear 92 in turn is mounted on one end of the second side brush 38. Bevel gear 94 is mounted on the other end of the second side brush 38. Complementary bevel gear 96 is mounted on shaft 98, which in turn is connected to one end of the rear brush 32. These gears are located in a fourth gear housing. The other end of the rear brush 32 is retained within the motor housing 65. This gear arrangement drivingly interconnects brushes 34, 36, 30, 38 and 32 respectively such that all of the brushes rotate in unison.

Figure 5:
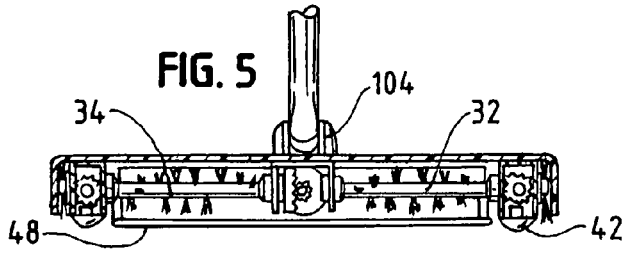
FIG. 5 is a cross sectional view taken along line 5-5 of FIG. 4 showing the sweeper head.

Shafts 78, 86 88 and 98 have an end that extends out from its respective gear housing 58. Securely mounted on the end of the shaft extending out from the gear housing is a corner brush 40. Thus the corner brushes 40 rotate with the respective rotating long brush or rear brush to which it is connected. The corner brushes spread outward at their tips such that their bristles are under the bottom of the short side 26 of the sweeper head 12. This is seen in FIGS. 2, 4 and 5.

Figure 10:
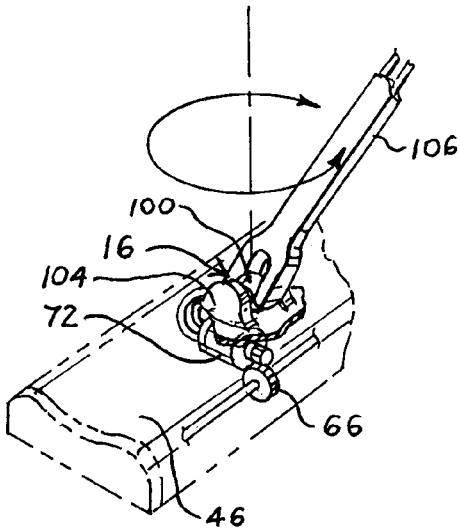
FIG. 10 is a perspective view with portions removed of the pivotal connection used to connect the elongated handle to the sweeper head.
Figure 11:
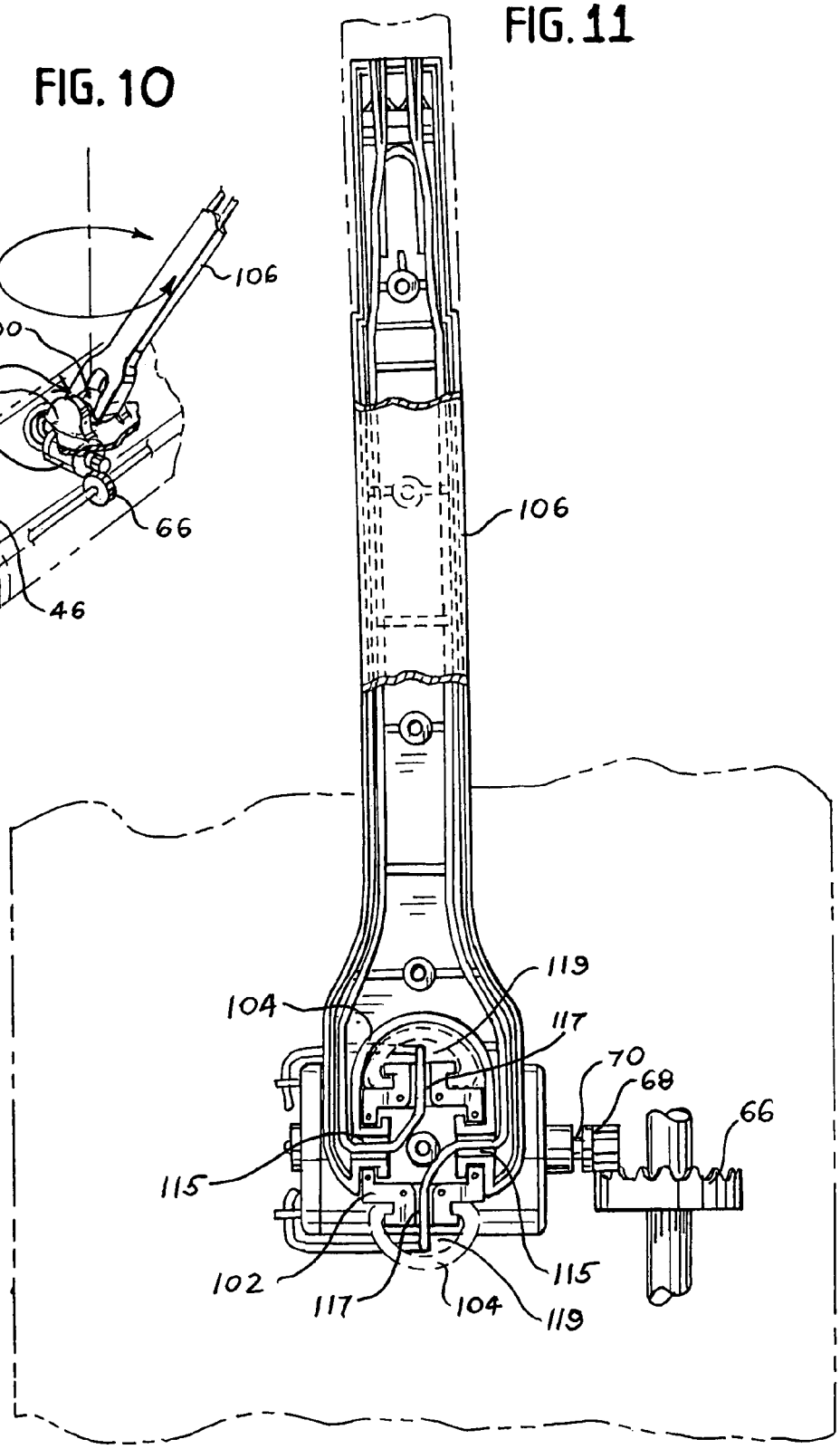
FIG. 11 is an enlarged view with portions removed of the lower end of the elongated handle, showing the ball and yoke and wire way passing through them.
Figure 12:
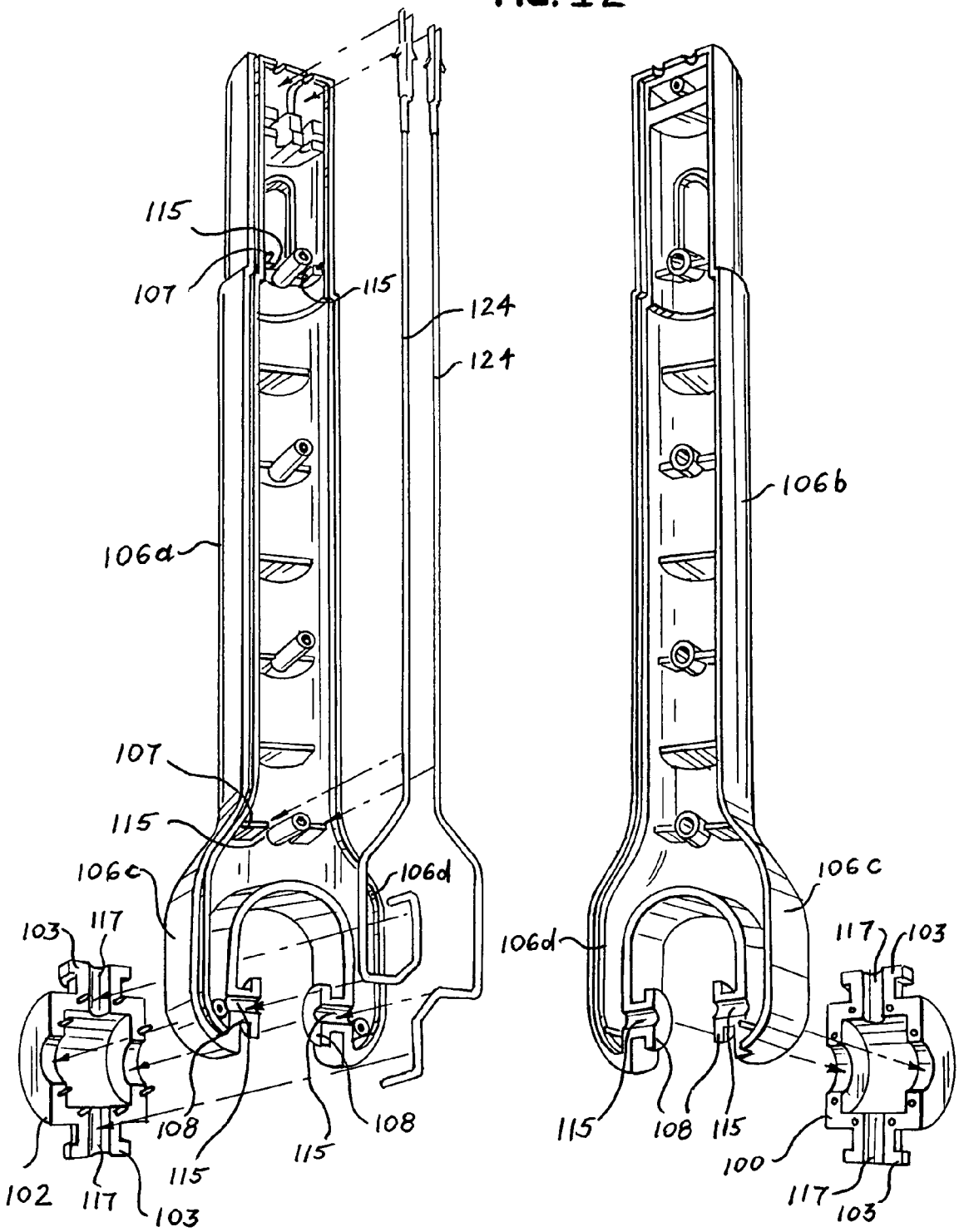
FIG. 12 is an exploded view of the ball and yoke pivotal connection showing the electrical connecting wire.

The elongated handle 14 is connected to the sweeper head 12 by means of the universal pivot 16, which is more clearly shown in FIGS. 6 and 9. The universal pivot connection 16 allows the handle 14 to swivel from the front to the back and from side to side with respect to the sweeper head such as seen in FIG. 10. This allows the sweeper head to easily rotate 360° in any direction about the pivot 16 so that it easily moves under furniture, ledges, shelves, etc. The universal pivot 16 is comprised of several components as seen in FIGS. 9, 11 and 12. There is a pivot ball top 100 and a pivot ball bottom 102 supported by pivot ball supports 104 that are on the top of the chassis 46. There is a cross arm yoke 106, comprised of a left cross arm yoke 106*a* and a right cross arm yoke 106*b*, which receives the pivot ball top 100 and bottom 102 between two arms 106*c* and 106*d* of the yoke 106. The left cross arm yoke 106*a* and the right cross arm yoke 106*b* are joined together to form the yoke 106. The pivot ball top 100 and bottom 102 are also joined together to allow the cross arm yoke 106 to rotate on the pivot ball supports 104 from one long side 28 to the opposite long side 28. This allows the elongated handle 14 to pivot about the sweeper head 12 as seen by the arrow A-A in FIG. 3.

The yoke 106 has pins 108 at its bottom end that are rotatably received in the pivot ball top 100 and bottom 102. (See FIG. 12). This provides a pivot point about which the handle 14 can rotate about the sweeper head 12 from one short side 26 to the other short side 26 as illustrated by the arrow B-B of FIG. 2. Other types of universal pivot connections can be utilized as will be apparent to those skilled in the art of mechanical pivot connections. The important point is to allow the handle 14 to freely rotate in all directions about the sweeper head 12.

The elongated handle 14 is assembled from a series of interlocking pipes or tubes 110, 112, 114 and 116. Spring loaded pins or locks 118 are placed in one end of each of the tubes 110, 112, and 114, which interlock with receiving holes in the next adjacent tube. One end of each of tubes 110, 112, and 114 has a reduced diameter to receive the end of the next tube above it so that the tube slides over the reduced diameter end.

The rechargeable battery 18 is also mounted on the elongated handle 14 in the battery box 20. The battery box 18 has a removable base 120, which allows access to a switch 122. The switch 122 turns the motor 72 on and off. Electrical wires 124 connect the motor 72 to the battery 20.

In FIG. 12 it is seen that there are first wire ways 115 formed by pins or guides 107 in the left cross arm yoke 106*a*. The first wire ways 115 are formed on both sides of the yoke 106*a* so that both the positive and negative electrical wires 124 are located in the yoke 106*a*. The wires 124 extend into the two arms 106*c* and 106*d* and the first wire way 115 passes through the pins 108 at the bottom of the yoke 106. As the pins 108 are received inside of the pivot ball top 100 and bottom 102, there is an open pathway for the wires 124 to follow.

As seen in FIG. 11, the ball top 100 and bottom 102 have a cylindrical protrusion 103 at opposite sides. These form a cylinder when the top 100 and bottom 102 are joined. The cylindrical protrusion 103 is rotatively received in the pivot ball support 104. There is a second wire way 117 formed in the cylindrical protrusion 103. The second wire way provides a path for the wires 124 to follow to enter a hollow passageway 119 or third wire way in the pivot ball support 104. This third wire way 119 extends through the ball support 104, through the top of the chassis 46 and into the motor housing 65. In this manner there are three wire ways 115, 117, 119 all in open communication to form a pathway for the electrical wires 124 to follow from the battery 20 to the motor 72. This configuration allows sweeper head 12 to freely pivot and rotate about the pivot connection 16 without having the wires 124 interfere with the free movement and rotation of the handle 14 with respect to the sweeper head 12.

The motor 72 and gear drive mechanism cause each of the brushes to rotate in a direction such that the dust or loose material is swept into the sweeper head 12 where it is received in the dust receiving tray 48. For example, as seen in FIG. 9, rear brushes 32 and 34 rotate in the direction of arrow C. Long brush 30 rotates in the opposite direction as illustrated by arrow D. This enables the sweeper 10 to pick up dust or debris when pushed or pulled in either a forward or backward direction.

The first side brush 36 rotates in direction of arrow B and the second side brush 38 rotates in the opposite direction of arrow F. Each of the corner brushes 40 are connected to and driven in the same direction as brushes 30, 32, and 34. As the brushes 40 are mounted at the outer perimeter of the gear housing 58 and under the short sides 26 of the sweeper head top 24, the corner brushes 40 can reach into tight corners and sweep the debris or dust out of the corners where it is directed into one of the first or second side brush 36 or 38. Then the debris is swept by one of the side brushes into the dust-receiving tray 48. In this manner the corner brushes always sweep the debris toward the center of the side brushes where it is swept into the receiving tray 48.

The overall height of the sweeper head 12 including the brushes and glides 42 is maintained as a very low profile sweeper to allow the sweeper to get under cabinets, chairs and low overhangs. The universal pivot 16 allows the sweeper head to easily rotate in any direction for ease in reaching tight spots and permits cleaning the entire floor surface. The battery 20 can be a conventional rechargeable battery that is recharged by plugging into a battery charger. The motor and battery are selected to provide adequate power to the brushes for enough time to perform a normal cleaning operation. All of the components can be easily and inexpensively manufactured from plastic or metal. Thus the weight of the sweeper 10 can thus be kept at a minimum for ease of maneuvering.

In an alternative embodiment, the sweeper head is triangular is shape. There are side brushes mounted along each of the sides, which replace the brushes 30, 32, 34, 36 and 38. The side brushes extend substantially the entire length of the sides and are mounted for rotation just as the brushes 30-38 are mounted for rotation. Similarly the side brushes are driven by a motor and gear arrangement as in the preferred embodiment. There are also corner brushes places at each of the corners. There are two corner brushes on each side that sweep debris from the corners toward the center of their respective side brush. The corner brushes rotate in opposite directions so that they both direct debris toward the cent of the side roller. This allows the sweeper to pick up corner debris regardless if it moves in the forward or backward direction. In this configuration there are a total of six corner brushes, two for each side. The corner brushes are mechanically connected to the motor so that they are driven in unison with the side rollers.

Thus there has been provided a floor sweeper that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A floor sweeper comprising:

an elongated handle having opposite top and bottom ends;

a substantially rectangular sweeper head with a front, back, and opposite first and second sides mounted at the bottom of the elongated handle;

a pivotal mounting means for attaching the bottom end of the elongated handle to the sweeper head;

a front roller mounted on the front for rotation in a first direction;

a rear roller mounted on the rear for rotation in a second direction opposite the first direction;

first and second side rollers mounted on the first and second sides respectively;

the front, rear and side rollers all having sweeping bristles mounted thereon;

at least one front corner brush mounted adjacent to the front and first side, the front corner brush mounted on a shaft for rotating in the same direction as the front roller, the front corner brush extending radially beneath the first side to sweep debris from under the first side toward the first side roller;

at least one rear corner brush mounted adjacent to the rear and first side, the rear corner brush mounted on a shaft for rotating in the same direction as the rear roller, the rear corner brush extending radially beneath the first side to sweep debris from under the first side toward the first side roller;

debris receiving means for receiving the debris swept by the rollers;

electric power source mounted on the elongated handle;

an electric motor operatively connected to at least one roller to provide rotative power to the at least one roller; and means for connecting the electric power source to the electric motor through the elongated handle and through the pivotal mounting means.

2. The floor sweeper of claim 1 and further comprising a first wire way within the elongated handle, a second wire way within the pivotal mounting means, the first and second wire ways in open communication with each other so that a wire can extend continuously from the electric power source through the pivotal mounting means.

3. The floor sweeper of claim 2 wherein the pivotal mounting means is a universal joint allowing the elongated handle to pivot 360° about the universal joint.

4. The floor sweeper of claim 3 wherein the universal joint comprises a yoke and ball, the ball mounted to the sweeper head by a support, and the first wire way extending through the yoke and the second wire way extending through the ball, with the first and second wire ways in open communication with each other.

5. The floor sweeper of claim 4 and further comprising a third wire way extending through the support, the third wire way in open communication with the second wire way.

6. The floor sweeper of claim 5 wherein the third wire way is in open communication with the motor.

7. The floor sweeper of claim 1 and further comprising an electric switch mounted in the elongated handle for turning the electric motor on and off.

8. A floor sweeper comprising:

an elongated handle having opposite top and bottom ends;

a sweeper head with at least a first, a second and a third side mounted at the bottom of the elongated handle;

a pivotal mounting means for attaching the bottom end of the elongated handle to the sweeper head;

the three sides connected to each other in a triangular configuration to define three corners, one corner at each point of connection of a side to an adjacent side, a first side roller mounted on the first side for rotation in a first debris sweeping direction;

a second side roller mounted on the second side for rotation in a second debris sweeping direction;

a third side roller mounted on the third side for rotation in a third debris sweeping direction;

the first, second and third rollers each having first and second opposite ends, and all rollers having sweeping bristles mounted thereon;

a corner brush mounted on each side adjacent to each corner at opposite first and second ends of their respective side roller, the corner brushes mounted for rotating in opposite directions with respect to each other, each corner brush extending radially beneath the side to which it is mounted and rotating in a direction to sweep debris from under the side toward the center of its respective side roller;

debris receiving means mounted on the sweeper head for receiving the debris swept by the side rollers;

electric power source mounted on the elongated handle;

an electric motor operatively connected to at least one roller to provide rotative power to the at least one roller; and means for connecting the electric power source to the electric motor through the elongated handle and through the pivotal mounting means.

9. A floor sweeper adapted to be moved over a surface and clean that surface by brushing, said sweeper comprising an elongated handle, a head having a periphery, a plurality of brushes moveably mounted on said head to extend there below so as to engage said surface, said brushes being rotatable about non-parallel axes angularly related to one another, and an electric motor operatively connected to said brushes to cause them to rotate about their axes in a direction such as to tend to sweep debris into said head, an elongated handle extending from said head and connected to said head by a universal joint allowing the elongated handle to pivot about the universal joint, the universal joint comprising a yoke and ball, a first wire way within the elongated handle and a second wire way extending through the yoke and the ball, with the first and second wire ways in open communication with each other, an electric power source mounted on the elongated handle so that an electrical connection can extend from the electric power source through the universal joint to the electric motor.

10. The floor sweeper of claim 9 wherein the universal joint allows the elongated handle to pivot 360° about the universal joint.

11. The floor sweeper of claim 9 and further comprising a third wire way extending through the head, the third wire way in open communication with the second wire way.

12. The floor sweeper of claim 11 wherein the third wire way is in open communication with the motor.

* * * * *